US005387968A

United States Patent [19]

Wakikaido et al.

[11] Patent Number: 5,387,968

[45] Date of Patent: Feb. 7, 1995

[54] SHEET-SIZE DETERMINING APPARATUS WITH SELECTION INDUCING MEANS

[75] Inventors: Takahiro Wakikaido, Yao; Kazuya Akura, Sakai, both of Japan

[73] Assignee: Mita Industrial Co., Ltd., Osaka, Japan

[21] Appl. No.: 950,667

[22] Filed: Sep. 25, 1992

[30] Foreign Application Priority Data

Oct. 11, 1991 [JP] Japan ..... 3-263621

[51] Int. Cl.[6] ..... G03G 21/00

[52] U.S. Cl. ..... 355/311; 355/209; 355/313

[58] Field of Search ..... 355/309, 311, 203, 208, 355/204, 209, 313; 271/9

[56] References Cited

U.S. PATENT DOCUMENTS 4,942,814 7/1990 Sugiyama ..... 355/311 X 5,065,198 11/1991 Yamashita et al. ..... 355/311 X 5,172,178 12/1992 Oushiden et al. ..... 355/309 X

*Primary Examiner*—A. T. Grimley

*Assistant Examiner*—Shuk Y. Lee

*Attorney, Agent, or Firm*—Beveridge, DeGrandi, Weilacher & Young

[57] ABSTRACT

A sheet size determining apparatus for use in a copying machine employing sheet containers capable of accommodating copy sheets of different sizes. The apparatus includes sensors for unidirectional detection of a dimension of sheets contained in the containers. An operator is induced by the apparatus to select the size of sheets actually contained in the containers, from possible sizes which, according to their orientation, would coincide with the dimension measured by the sensor. The size of the sheets to be utilized in a subsequent image forming operation thus is determined.

33 Claims, 8 Drawing Sheets

SHEET-SIZE DETERMINING APPARATUS WITH SELECTION INDUCING MEANS

BACKGROUND OF THE INVENTION

The present invention relates to a sheet size determining apparatus, and more particularly it relates to a sheet size determining apparatus for use in an image forming apparatus having sheet containers which contain sheets of different sizes.

One class of copying machines has the capacity to copy onto A3 size sheets wherein the sheets of copy paper are transported widthwise from a tier of sheet drawers, each of which contains a different size of sheet and can be drawn out from the copying machine body. The sheets are normally transported in their sheet width direction in such a copying machine, and sensors for detecting sheet size provided in the sheet drawers only detect the sheet dimension in the direction perpendicular to the transportation direction, i.e., in the direction of the machine depth. This is because sheets of all ordinarily required sizes can be transported in the sheet width direction in a copying machine which is capable of handling A3 size sheets, making it unnecessary to transport sheets in their sheet length direction. Furthermore, copying speed is expedited by transportation of the sheets in the sheet width direction as opposed to the sheet length direction.

Problems may arise in the forgoing copying machine when it is used in combination with an automatic original feeder and operated in a mixed-size mode. The mixed size mode therein is for handling a stack of originals containing, for example, A3- and A4-size originals.

No difficulties arise if the A3- and A4-size originals in such a stack handled in the mixed-size mode are arranged such that transportation by the automatic original feeder is in the width direction of the sheets of both sizes. However, a stack containing originals previously bound by a stapler or having punch-holes can create handling problems, if in such a case the stack includes A4-size originals situated such that their lengthwise dimension is coincident with the widthwise dimension of the A3-size originals in the direction of transport.

As explained, the sheet drawers, provided for supplying sheets to the image forming part of the copying machine, have sensors which detect copy paper sheet dimension only in the direction of the machine depth. Wherein a mixed stack of originals of A3 and A4 size as above is set into the automatic original feeder in the mixed size mode, A3- and A4-size sheets of copy paper are so placed into respective sheet drawers as to be correspondingly oriented to the originals. However, the apparatus then cannot distinguish, by its machine depthward dimension-detecting sensors, A4- from A5-size sheets, since the widthwise dimension of the former corresponds to the lengthwise dimension of the latter, A5-size sheets.

Although additional sensors could be provided in order to determine whether the sheets to be transported from a sheet drawer are located widthwise or lengthwise, the added structural complexity would increase manufacturing costs.

SUMMARY OF THE INVENTION

It is an object of the present invention to enable the determination of the size of sheets contained in a sheet container without adding to the structural complexity of the size-detecting means.

A sheet size determining apparatus according to the present invention is an apparatus for use in an image forming apparatus employing sheet containers capable of accommodating sheets of several different sizes. The sheet size determining apparatus takes a sheet-dimension measurement along one direction in the sheet container. Then it induces an operator to select that sheet size of the sheets actually contained in the sheet container from possible sizes determined in accordance with the detected sheet dimension. For example, wherein a dimension corresponding to the length of an A5-size sheet is detected, the apparatus assumes that the possible sizes of the contained sheets are either A5, in which case the detected dimension is the length of the sheet, or A4, in which case the dimension detected is the width of the sheet, and then it induces the operator to select one of the two sizes. Upon selection by the operator of the actual size from the possible sizes, the apparatus determines the sheet size to utilize.

Thus, according to the present invention, the size of sheets contained in a sheet container can be determined without complicating the structure of the sheet size detecting means. This enables the correct selection of sheet size, even wherein the image forming apparatus is combined with an automatic original feeder and operated in a mixed size mode, in which a stack of originals includes sheets disposed widthwise relative to and coincident with sheets disposed lengthwise.

The foregoing and other objects and advantages of the present invention will be more fully apparent from the following detailed description.

DESCRIPTION OF THE PREFERRED EMBODIMENT

Figure 1:
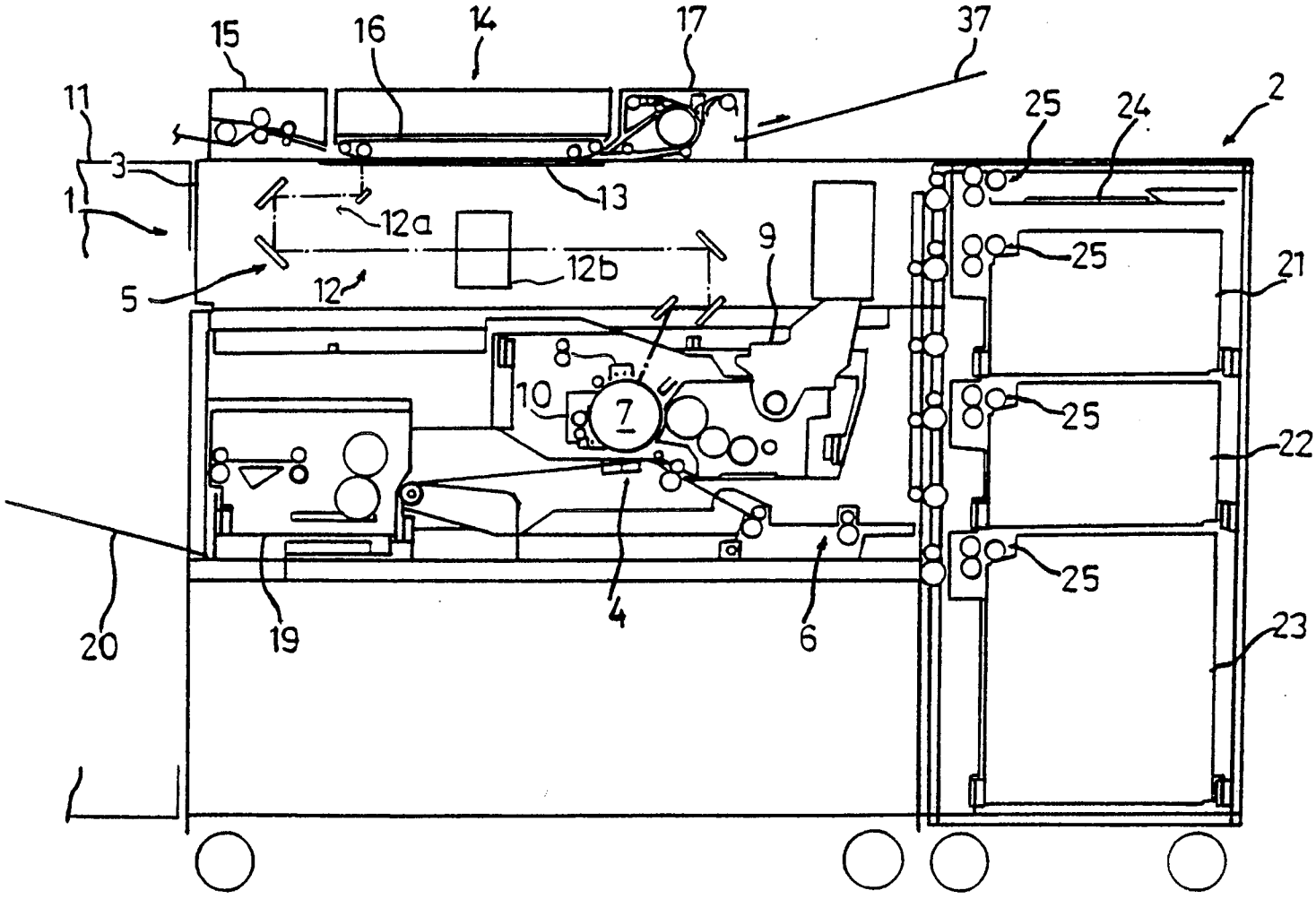
FIG. 1 is a schematic elevational view of a copying machine to which an embodiment of the present invention is applied.

As shown in FIG. 1, a copying machine is composed principally of a copying machine body 1, and a sheet feeding unit 2 attached on a side of the copying machine body 1. The copying machine body 1 includes a case 3, an image forming section 4 located in the middle of the case 3, an original scanning section 5 located above the image forming section 4, and a sheet transportation path 6 for both supplying and discharging sheets to the image forming section 4.

The image forming section 4 comprises a photoconductive drum 7 disposed centrally, and a charger 8, a developing unit 9, and a cleaning unit 10, etc. surrounding the photoconductive drum 7.

The original scanning section 5 comprises an optical exposure system 12 disposed above the image forming section 4, an original retainer 13 disposed above the optical exposure system 12, and an automatic original feeder 14 disposed on the original retainer 13. The automatic original feeder 14 has a sheet supplying part 15 on the left, a sheet transporting belt 16 in the middle, and a sheet discharging part 17 on the right in the figure.

The sheet transportation path 6 consists of a sheet feeding path located to the right of the image forming section 4, and a sheet discharging path located to the left thereof. Provided the sheet discharging path is a fixing unit 19. A copy tray 20 is provided on the left of the fixing unit 19.

The sheet feeding unit 2 includes an uppermost, or first sheet drawer 21, a middle, or second sheet drawer 22, and a lowermost, or third sheet drawer 23. Above the first sheet drawer 21, a bypass tray 24 is provided. Each of sheet drawers 21 to 23 and bypass tray 24 has a sheet feeding mechanism 25 on the side closest to the sheet transportation path 6, whereby the sheet transportation path 6 is supplied with sheets from the sheet feeding unit 2 on a sheet-by-sheet basis.

Figure 2:
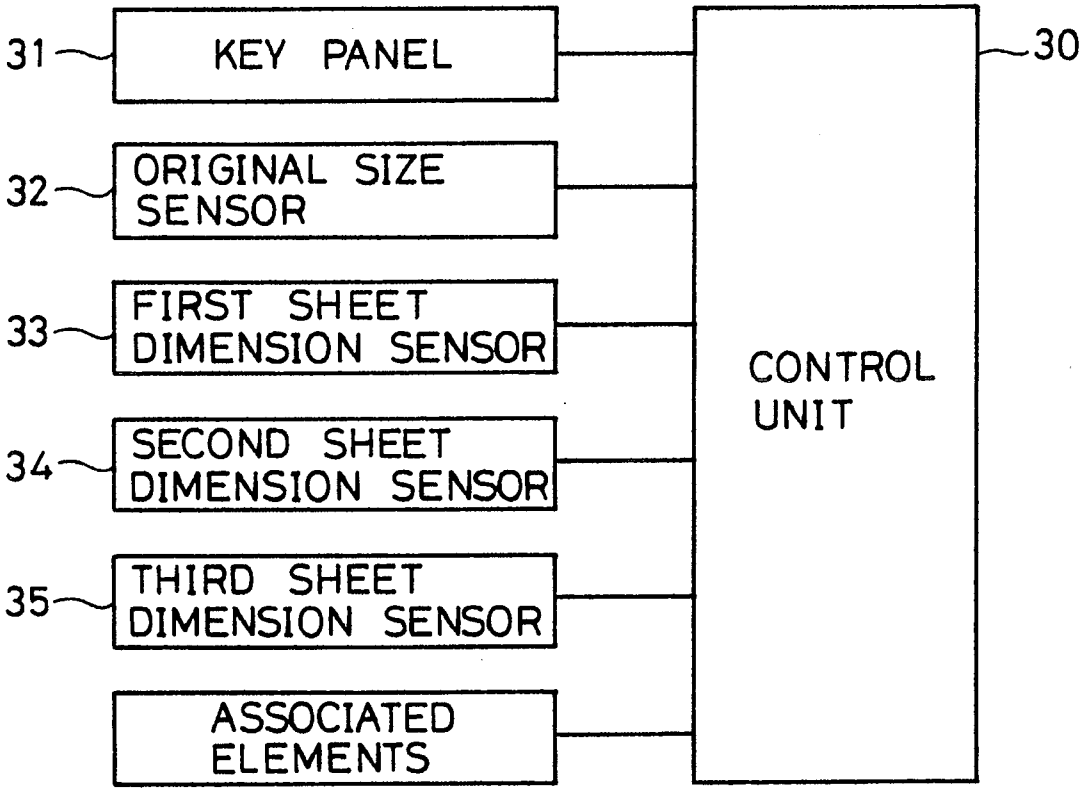
FIG. 2 is a block diagram of a control unit.

This copying machine has a process control unit 30 as shown in FIG. 2. The control unit 30 comprises microcomputers consisting of a CPU, ROMs, RAMs, etc. Connected to the control unit 30 are a key panel 31 provided on the upper surface of the case 3, an original-size sensor 32 provided in the automatic original feeder 14, first, second and third sheet dimension sensors 33 to 35 provided in the first, second and third sheet drawers, respectively, and associated elements.

Figure 3:
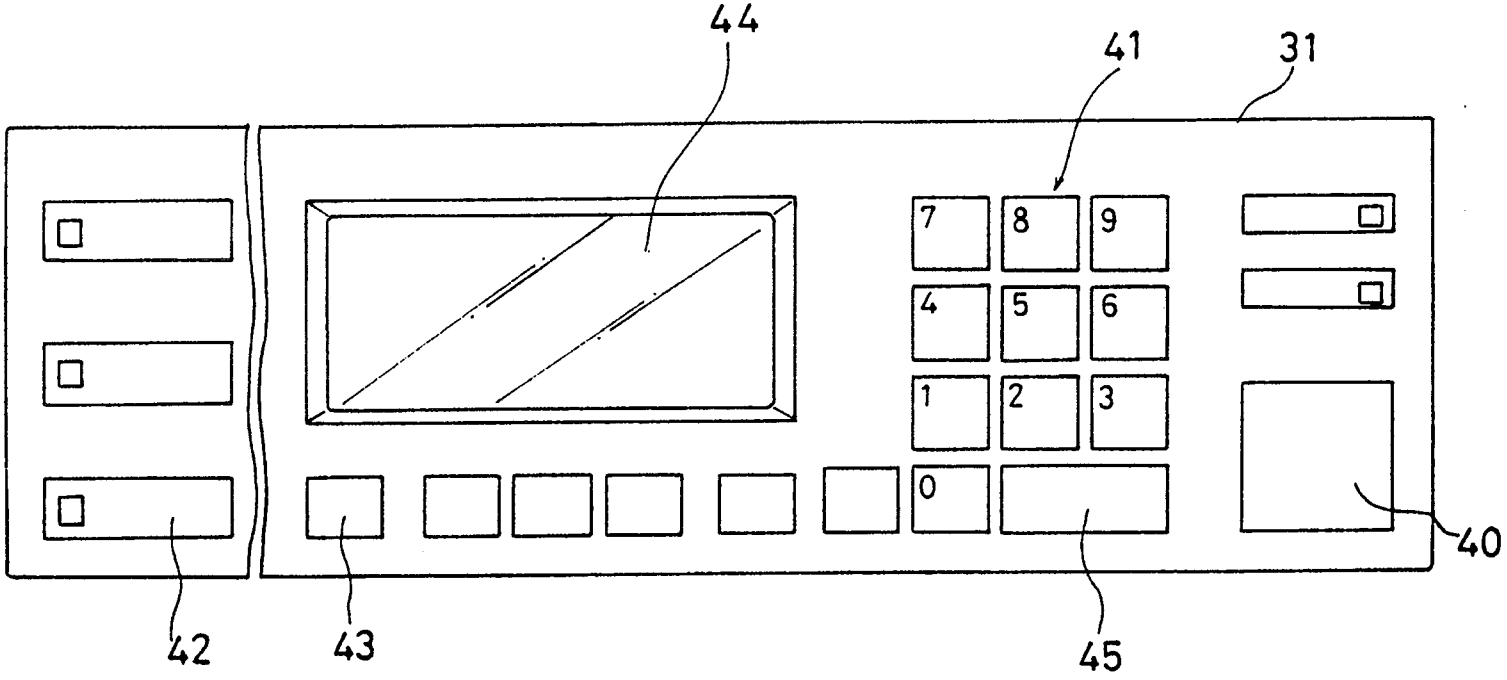
FIG. 3 is a plan view of a key panel.

The key panel 31, as shown in FIG. 3, comprises a print key 40 for starting a printing operation; decimal keys 41 for instructing, inter alia, copy number; a mixed-size mode key 42 for selecting a mixed size mode; a mode/instruct key 43 for changing the designated mode between an automatic paper selection (APS) mode and an automatic image-scaling (AIS) mode, and for operator-instructed input of that sheet size actually contained in a given one of the sheet drawers 21 to 23; an all-clear key 45 to reset the statuses of the AIS mode, APS mode, etc. of the copying machine to initial conditions; and other, miscellaneous keys. Furthermore, the key panel 31 includes a display 44 composed of LED devices for displaying sizes of sheets placed into the bypass tray 24 and the sheet drawers 21 to 23, copy density, copy number and so on.

The operation of the above embodiment will now be described in accordance with the process control flow charts of FIGS. 4 to 7. In order to simplify the description, an example will be given in which the first sheet drawer 21 contains either A4-size sheets disposed lengthwise, or A5-size sheets disposed widthwise relative to the transport direction.

Figure 4:
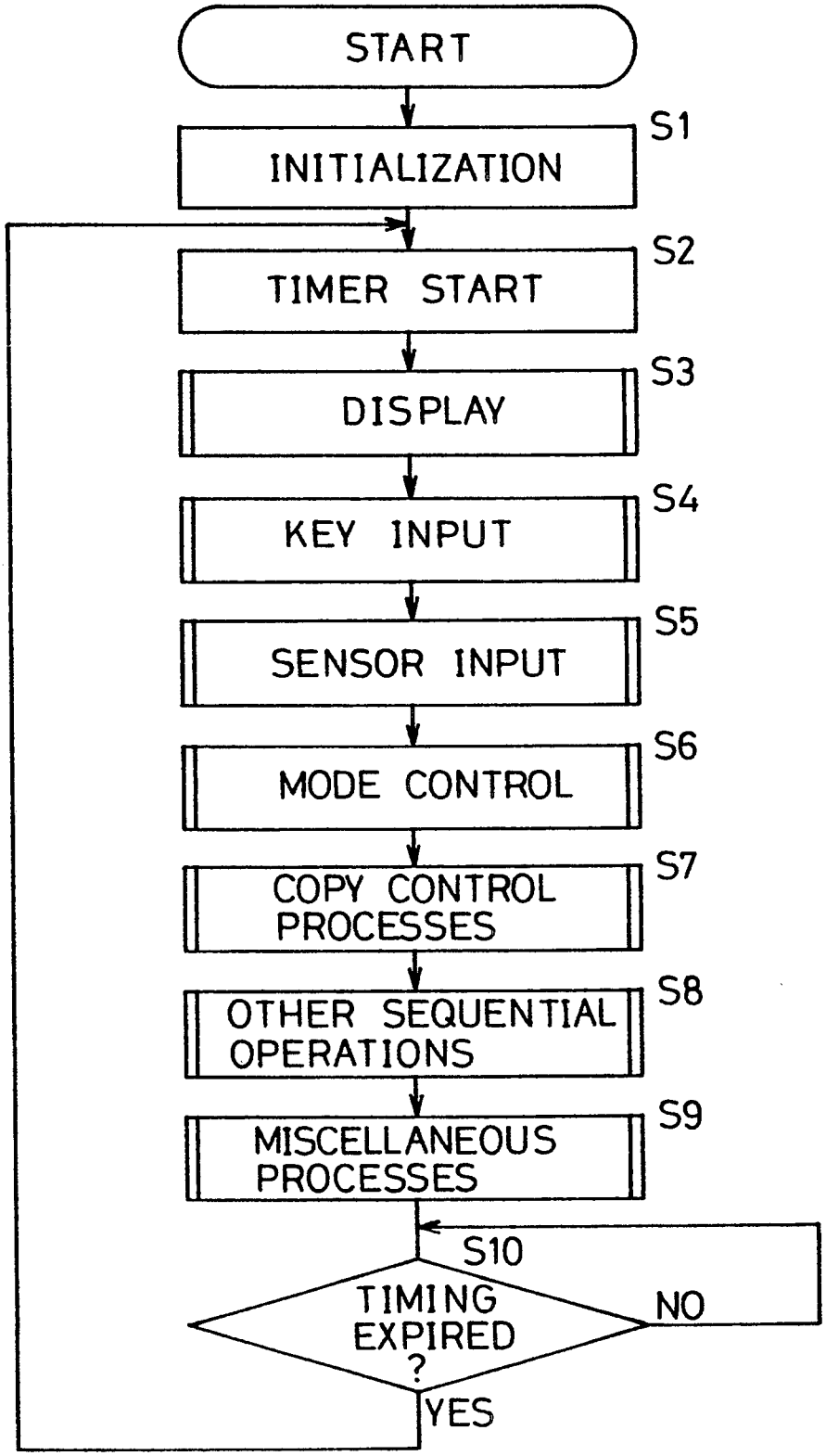
FIGS. 4, 5, 6, and 7 are flow charts of a control program.

As the process control program starts, an initialization is performed at step S1 of FIG. 4, in which, inter alia, the copy number is set at "1", and the fixing unit 19 is heated to a predetermined temperature. Through initialization, an APS flag is set to indicate the APS mode, wherein the mixed size mode has not been selected. After the initialization, the program proceeds to step S2.

At step S2, an internal timer starts, which is provided for measuring the processing time of one cycle of the main routine. At step S3, a display process is carried out, whereby the display 44 begins display, and several of the LEDs start to flash on the key panel 31. At step S4, key input processes are carried out in response to the status of the key panel 31. Then at step S5, among the sensors the original-size sensor 32 and the sheet dimension sensors 33 to 35 are monitored. At step S6, a mode control subroutine is executed in which the condition of certain of the flags is changed in accordance with the setting of various operation modes such as the mixed-sized mode. At step S7, a copy routine is executed to control the copying operation through several sequential control processes. At step S8, a sequential control routine is executed to control other sequential operations such as a heater control process. At step S9, miscellaneous processes are carried out. At step S10, the program waits for the timing by the internal timer started at step S2 to expire. Thereupon, the program returns to step S2.

Figure 5:
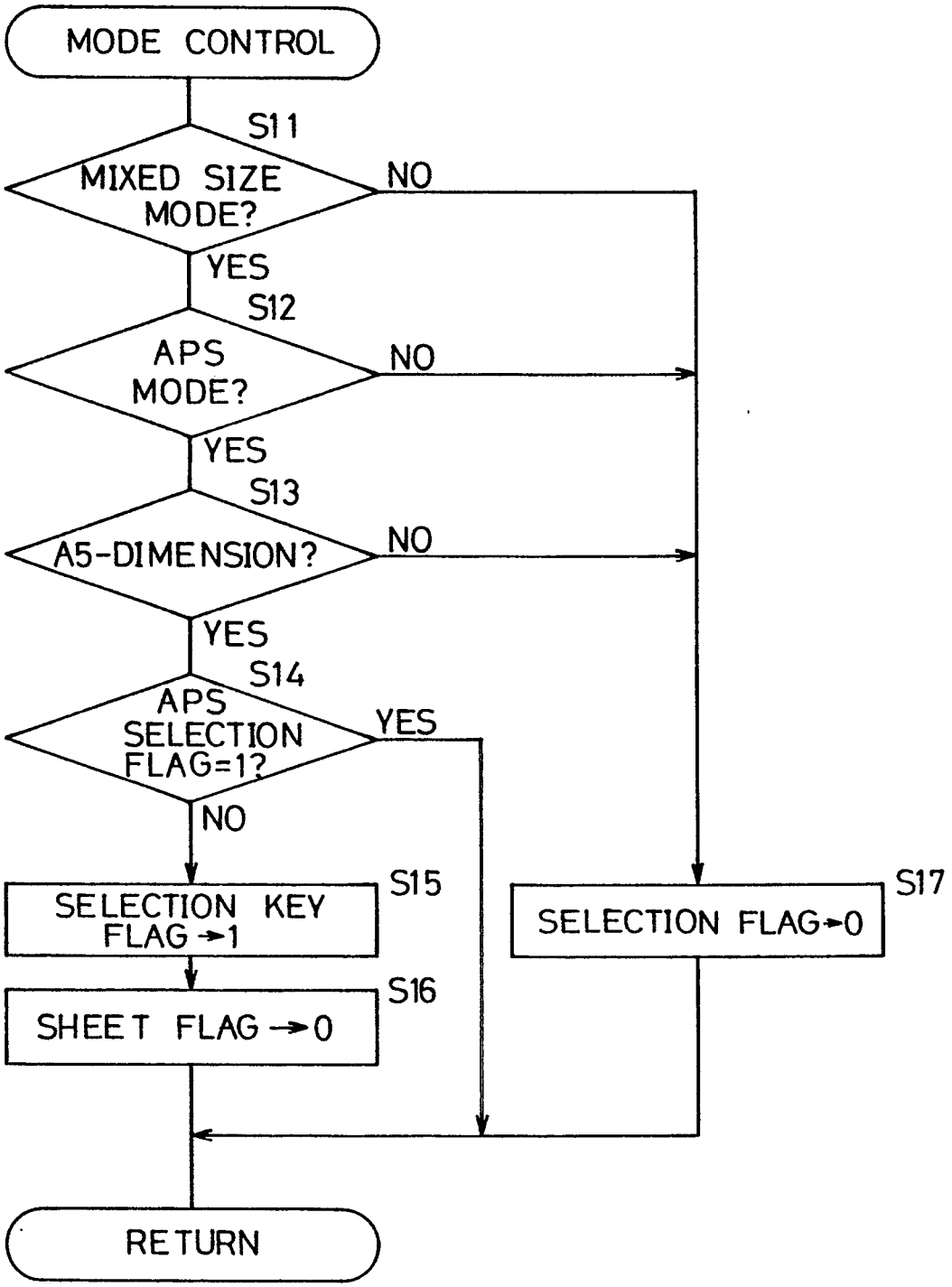

The mode control subroutine of step S6 is shown in FIG. 5 in detail. At step S11, it is determined whether the mixed-size mode has been designated. The determination depends upon whether an operator has pressed the mixed-size mode key 42. If the mixed-size mode has been designated, the program proceeds to step S12, at which it is determined whether the APS mode has been designated. The determination at step S12 depends upon whether the APS flag is set at "1" or not. When the APS mode has been designated, the program proceeds to step S13, at which it is determined whether sheets installed in the sheet drawer 21 are of dimension in the machine depth direction corresponding to the length of an A5-size sheet. The determination depends upon the ON–OFF condition of the first sheet dimension sensor 33.

If the detected measurement corresponds to A5 dimensional length, i.e., if the first sheet dimension sensor 33 is on, the program proceeds to step S14, at which it is determined whether the APS selection flag is set at "1". This selection flag indicates that the condition exists in which an operator can select from either A5 or A4R sizes with the selection key 43. ("R" stands for "Reduction," and is now taken to indicate merely longitudinal sheet positioning, in which copy sheets are situated in a sheet drawer for feeding lengthwise, in the required orientation for magnification/reduction copying.) When the selection flag is reset, or at "0", the program proceeds to step S15, at which a selection key flag is set at "1". At step S16, a sheet flag is reset to "0". The sheet flag, when at "0" indicates that A5-length sheets positioned for widthwise transport are selected, whereas when at "1", the indication is that A4-width sheets positioned for lengthwise transport are selected.

Meanwhile, if it is determined at step S11 that the mixed size mode has not been designated, or at step S2 that the APS mode has not been designated, or at step S13 that no sheets of machine a depthward dimension corresponding to A5 sheet length are installed in the sheet drawer 21, the program proceeds to step S17, at which the selection flag is reset to "0". After the execution of either step S16 or S17, the program returns to the main routine.

To summarize the above process; it is determined at step S13 whether sheets of dimension corresponding to the length of A5-size sheets are installed in the sheet drawer 21, according to the detection of the first sheet dimension sensor 33, then the selection flag is set at step S15 so as to allow an operator to select from either A4 or A5 sizes when the sheets installed in the sheet drawer 21 are of according dimension and positioning.

Figure 6:
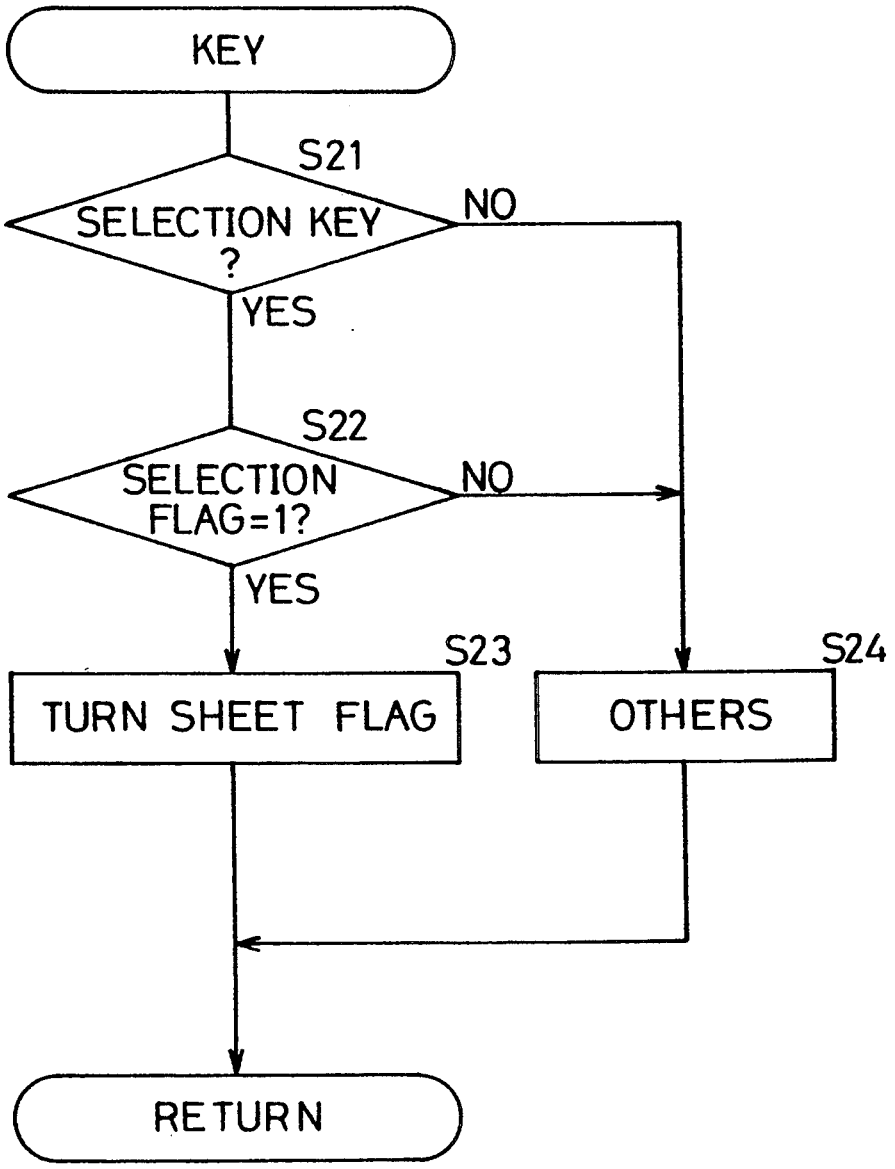

In the key input subroutine of step S4, as shown in FIG. 6, it is determined at step S21 whether the selection key 43 has been pressed or not. If the selection key 43 has been pressed, the program proceeds to step S22, at which it is determined whether the selection flag is set at "1", wherein the operator can select one from two different sizes. If the selection flag is set at "1", the program proceeds to step S23, at which the sheet flag is switched to that condition other than its present condition, i.e., from "1" to "0" or from "0" to "1". Meanwhile, if it is determined either at step S21 that the selection key 43 has not been pressed, or at step S22 that the selection flag is not set at "1", the program proceeds to step S24, at which other key processes are carried out, and then the program returns to the main routine.

Thus, in the key input subroutine of FIG. 6, when the selection flag is set at "1" to provide the size selection option, by pressing the selection key 43, the sheet flag is switched to designate the other of the two sheet sizes for handling. For example, if A5 sheet size is the presently-selected status, pressing the selection key 43 changes the selected size to A4.

Figure 7:
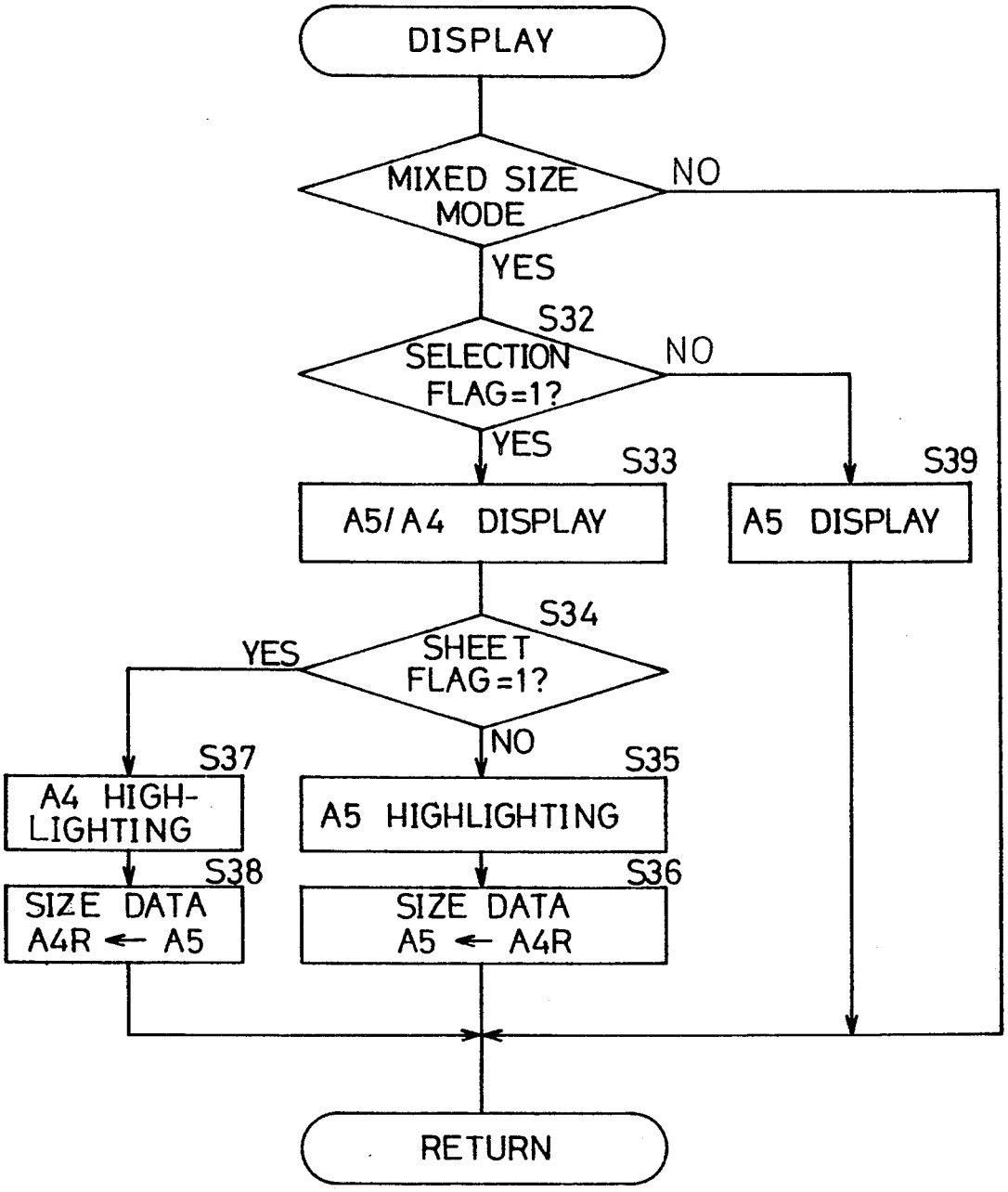
Figure 8:
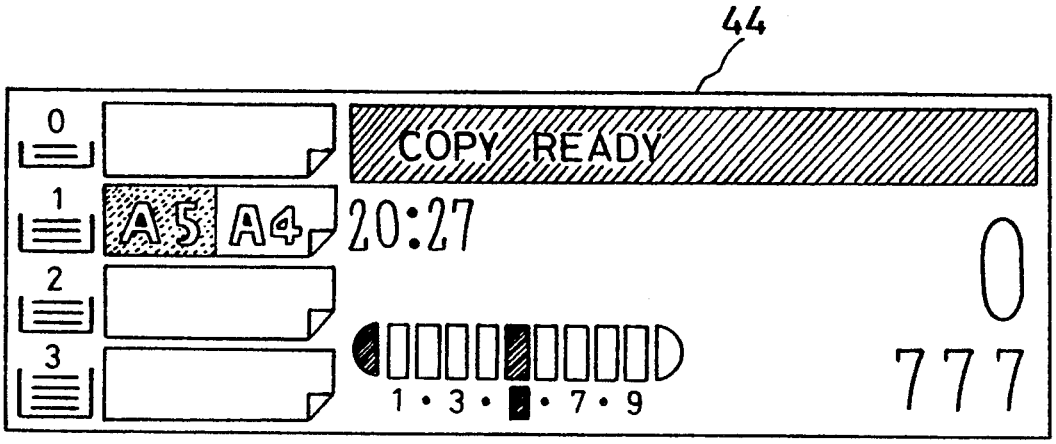
FIGS. 8 and 9 are plan views showing display examples.
Figure 9:
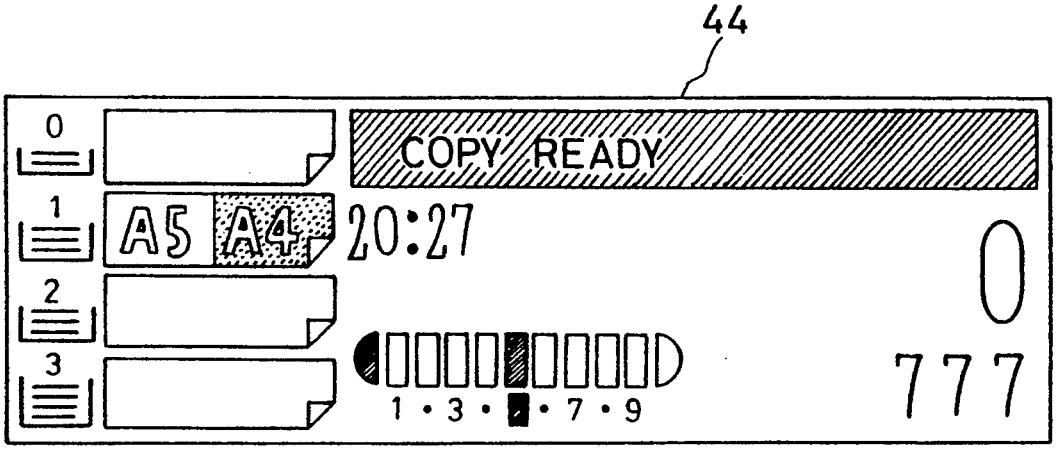

In the display process subroutine of step S3, as shown in FIG. 7, it is determined first at step S31 whether the mixed-size mode has been designated or not. Wherein the mixed size mode has been designated, the program proceeds to step S32, at which it is determined whether the selection flag is set at "1". If the selection flag is set at "1", the program proceeds to step S33, at which the display 44 indicates "A5 A4" in a display area for the sheet drawer 21. At step S34, it is determined whether the sheet flag is set at "1". Wherein the selection flag is not set at "1", the program proceeds to step S35 at which only "A5" is highlighted on the "A5 A4" display (see FIG. 8). At step S36, the size data is changed from "A4R" to "A5". Meanwhile, if the sheet flag is set at "1" at step S34, the program proceeds to step S37 at which only "A4" is highlighted on the "A5 A4" display (see FIG. 9). At step S38, the size data is changed from "A5" to "A4R".

Thus, the ensuing copying process in the APS mode will be carried out according to the selected size data, despite the potential ambiguity of the data detected by the first sheet dimension sensor 33 of the sheet drawer 21.

If the mixed size mode has not been designated at step S31, the program directly proceeds to the main routine. If the selection flag is not set at "1" at step S32, the program proceeds to step S39, at which the display 44 indicates "A5" in the display area for the sheet drawer 21. After the execution of either of steps S36, S38 or S39, the program proceeds to the main routine.

Sheet size determinations for the other sheet drawers 22 and 23 are made likewise as described in the above for the sheet drawer 21.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A sheet size determining apparatus for use in an image forming apparatus which has a sheet container capable of accommodating sheets of different sizes, and which is operable in a conjunctive mode selected from either a mixed sheet-size operating mode or a single sheet-size operating mode, and from either an automatic sheet-size selection mode or an automatic image-scaling mode, said sheet size determining apparatus comprising:

means for detecting a dimension of sheets contained in said container, in a corresponding direction;

means for inducing an operator to select that size of sheet actually contained in said sheet container from possible sizes determined in accordance with a sheet dimension detected by said detecting means;

a first mode-selection key for selecting one from said mixed sheet-size and single sheet-size operating modes; and a second mode-selection key for selecting one from said automatic sheet-size selection and said automatic image-scaling modes.

2. An apparatus according to claim 1, wherein said inducing means induces the operator to select between a first sheet size, and a second sheet size of which widthwise dimension conforms to a lengthwise dimension of said first sheet size.

3. An apparatus according to claim 2, wherein said inducing means comprises a selection key provided in said image forming apparatus, for operator instruction of said sheet size selection.

4. An apparatus according to claim 3, wherein said detecting means includes a sheet dimension sensor for detecting a dimension of sheets contained in said sheet container.

5. An apparatus according to claim 1, wherein said inducing means further comprises a display for displaying possible sizes of sheets contained in said sheet container.

6. An apparatus according to claim 5, wherein said inducing means distinctively displays, on said display, a sheet size selected by the operator.

7. An apparatus according to claim 6, wherein said inducing means comprises a selection key provided in said image forming apparatus, for operator instruction of said sheet size selection.

8. An apparatus according to claim 7, wherein said detecting means includes a sheet dimension sensor for detecting a dimension of sheets contained in said sheet container.

9. An apparatus according to claim 8, wherein said inducing means is enabled when said image forming apparatus is operated in said mixed sheet-size operating mode and said automatic sheet-size selection mode.

10. An apparatus according to claim 1, wherein said inducing means determines possible sheet sizes, one of which is of length corresponding to the dimension detected by said detecting means, and the other of which is of width corresponding to said detected dimension.

11. An apparatus according to claim 10, wherein said inducing means comprises a selection key provided in said image forming apparatus, for operator instruction of said sheet size selection.

12. An apparatus according to claim 11, wherein said inducing means further comprises a display for displaying possible sizes of sheets contained in said sheet container.

13. An apparatus according to claim 12, wherein said inducing means distinctively displays, on said display, a sheet size selected by the operator.

14. An apparatus according to claim 1, wherein said inducing means is enabled when said image forming apparatus is operated in said mixed sheet-size operating mode and said automatic sheet-size selection mode.

15. An image forming apparatus comprising:

a scanner for obtaining image information from original sheets;

a sheet container capable of accommodating copy sheets of different sizes;

means for forming toner images onto copy sheets according to said image information;

means for detecting a dimension of copy sheets contained in said container in a corresponding direction;

means for inducing an operator to select the size of a copy sheet actually contained in said sheet container from possible sizes determined in accordance with a sheet dimension detected by said detecting means; and means for carrying out an image forming operation in accordance with a sheet size selected by said inducing means, wherein said image forming apparatus is operable in a conjunctive mode selected from either a mixed sheet-size operating mode or a single sheet-size operating mode, and from either an automatic sheet-size selection mode or an automatic image-scaling mode.

16. An apparatus according to claim 15, further comprising:

a first mode-selection key for selecting one from said mixed sheet-size and single sheet-size operating modes; and a second mode-selection key for selecting one from said automatic sheet-size selection and said automatic image-scaling modes.

17. An apparatus according to claim 16, wherein said inducing means is enabled when said image forming apparatus is operated in said mixed sheet-size operating mode and said automatic sheet-size selection mode.

18. An apparatus according to claim 17, wherein said inducing means further comprises a display for displaying possible sizes of sheets contained in said sheet container.

19. An apparatus according to claim 18, wherein said inducing means distinctively displays, on said display, a sheet size selected by the operator.

20. An apparatus according to claim 15, wherein said inducing means induces the operator to select between a first sheet size, and a second sheet size of which widthwise dimension conforms to a lengthwise dimension of said first sheet size.

21. An apparatus according to claim 20, wherein said inducing means comprises a selection key provided in said image forming apparatus, for operator instruction of said sheet size selection.

22. An apparatus according to claim 21, wherein said detecting means includes a sheet dimension sensor for detecting a dimension of sheets contained in said sheet container.

23. An apparatus according to claim 15, wherein said inducing means further comprises a display for displaying possible sizes of sheets contained in said sheet container.

24. An apparatus according to claim 23, wherein said inducing means distinctively displays, on said display, a sheet size selected by the operator.

25. A sheet size determining method for an image forming apparatus which has a sheet container capable of accommodating sheets of different sizes, and which is operable in a conjunctive mode selected from either a mixed sheet-size operating mode or a single sheet-size operating mode, and from either an automatic sheet-size selection mode or an automatic image-scaling mode, said method comprising the steps of:

placing either sheets of a first size, or sheets of another, second size of which a widthwise dimension conforms to a lengthwise dimension of said first size sheets in said sheet container;

detecting a unidirectional dimension of said sheets contained in said sheet container;

selecting one from said mixed sheet-size and single sheet-size operating modes;

selecting one from said automatic sheet-size selection and said automatic image-scaling modes;

inducing an operator to select the size of the sheets actually contained in said sheet container from possible sizes determined in accordance with said detected sheet dimension; and performing an image forming process according to said size as selected by said selection-inducing step.

26. A method according to claim 25, wherein said selection-inducing step includes a step of determining possible sheet sizes, one of which is of length corresponding to the dimension detected by said detecting step, and the other of which is of width corresponding to said detected dimension.

27. A method according to claim 26, wherein said selection-inducing step further includes a step of displaying possible sizes of sheets contained in said sheet container.

28. A method according to claim 27, wherein the performance of said displaying step distinguishes in display that sheet size selected by the operator.

29. A method according to claim 28, wherein said detecting step includes a step of detecting a dimension of sheets contained in said sheet container.

30. A method according to claim 29, wherein said selection-inducing step is enabled when said image forming apparatus is operated in said mixed sheet-size operating mode and said automatic sheet-size selection mode.

31. A method according to claim 25, wherein said selection-inducing step is performed by a selection key, provided in said image forming apparatus, for operator instruction of said sheet size selection.

32. A method according to claim 31, wherein said detecting step includes a step of detecting a dimension of sheets contained in said sheet container.

33. A method according to claim 32, wherein said selection-inducing step further includes a step of displaying possible sizes of sheets contained in said sheet container.

* * * * *